US005554472A

United States Patent [19]

Aizawa

[11] Patent Number: 5,554,472

[45] Date of Patent: Sep. 10, 1996

[54] ELECTROPHOTOGRAPHIC PHOTOCONDUCTORS

[75] Inventor: Koichi Aizawa, Kawasaki, Japan

[73] Assignee: Fuji Electric Co., Ltd., Kanagawa, Japan

[21] Appl. No.: 393,308

[22] Filed: Feb. 22, 1995

[30] Foreign Application Priority Data

Feb. 23, 1994 [JP] Japan ..... 6-024633

[51] Int. Cl.[6] ..... G03G 5/047; G03G 5/10; G03G 5/14

[52] U.S. Cl. ..... 430/58; 430/62; 430/64; 430/69

[58] Field of Search ..... 430/58, 62, 69

[56] References Cited

U.S. PATENT DOCUMENTS 4,689,284 8/1987 Kawamura et al. ..... 430/69 X

FOREIGN PATENT DOCUMENTS 45707 2/1977 Japan .
42380 10/1980 Japan .
34099 1/1982 Japan .
236060 10/1991 Japan ..... 430/69

*Primary Examiner*—Roland Martin
*Attorney, Agent, or Firm*—Spencer & Frank

[57] ABSTRACT

An electrophotographic photoconductor comprises: an electroconductive substrate consisting of an aluminum alloy having an iron content of 0.1 percent by weight or less; an intermediate layer formed on said electroconductive substrate; a charge generation layer formed on the intermediate layer; and a charge transport layer formed on the charge generation layer. The intermediate layer comprises an alcohol-soluble resin and has a thickness of 0.5 μm or more.

8 Claims, 1 Drawing Sheet

ELECTROPHOTOGRAPHIC PHOTOCONDUCTORS

BACKGROUND OF THE INVENTION

1. Field of the Invention

The present invention relates to an organic electrophotographic photoconductor in the type of having functionally distinguished laminate layers.

2. Description of the Related Art

As disclosed in Japanese Patent Application Publications No. 42380/1987 and 34099/1985, in recent years, organic electrophotographic photoconductors of the type having functionally distinguished organic laminate layers, a charge-generation layer and a charge-transport layer which are applied on an electroconductive substrate in that order, have been developed and provided in practical uses. In general the electrophotographic photoconductor is formed by the process including steps of: preparing a solution by dissolving and dispersing an organic charge-generation material and a resin binder in an organic solvent; applying the solution on a surface of an electroconductive substrate made of an aluminum alloy and drying the solution to provide a charge-generation layer; preparing another solution by dissolving and dispersing an organic charge-transport material and a resin binder in an organic solvent; applying the solution on a surface of the charge-generation layer and drying the solution to provide a charge-transport layer. Additionally, the charge-transport layer may include an additive such as an antioxidant.

In spite of the structure described above, the conventional organic electrophotographic photoconductor may readily cause some troubles, for example image deterioration such as a light gray appearance in non-image areas and a blank unprinted appearance in image areas in a copy formed by a copying machine of a positive development type. In addition, printing defections such as black dots in non-image areas and lowering of printing concentration under a repetitive printing process may be also observed in a copy formed by an electrophotocopying machine of a negative development type, such as a laser printer.

It is considered that these troubles are caused by variations in the physical and chemical properties and also variations in rough surfaces of the charge-generation layer and the charge-transport layer which are formed on a defective surface of the electroconductive substrate. To improve these troubles, there is an idea of providing a resin layer and an intermediate layer or sub-layer between the electroconductive substrate and the charge-generation layer. Furthermore, it has been known that an alcohol-soluble polyamide resin can be provided as a preferable material for the layer (see Japanese Patent Application Publication No. 45707/1983 and Japanese Patent Application Laying-open No. 168157/1985).

In the steps of manufacturing the conventional electrophotographic photoconductor described above, a surface of the electroconductive substrate is shaved with a diamond tool or the like and then the shaved surface is ground to a predetermined surface roughness by means of grinding or the like. After the grinding step, machine oil, grinding oil, and other unnecessary materials are removed from the surface of the substrate by treating with a cleaning agent. Then the intermediate layer, the charge-generation layer, and the charge-transport layer are applied on the substrate in that order. Conventionally, an appropriate organic base solvent such as trichloroethylene and Freon® has been used as the above cleaning agent. However, the organic base solvents are now regarded as industrial pollutants that deplete the ozone layer. In recent years, therefore, the use of water-soluble weak- alkali detergents has been recommended for avoiding the environmental disruption. In this case, however, there is a problem of forming etch-pits on the surface of the substrate during the step of washing the substrate with the weak alkali detergent.

The electroconductive substrate of aluminum alloy can be easily etched by the water-soluble detergent such as the weak alkali. In this connection, furthermore, the aluminum alloy comprises an area to be easily etched by the detergent. That is, the aluminum alloy usually comprises an element such as iron that has a higher oxidation-reduction potential compared with that of aluminum, so that for example an iron-rich portion and its surroundings formed in the aluminum alloy can be more easily etched than the other portions. In this case, an etched-pit with a diameter of in the order of $1\times10^{-1}$ to $3\times10^{-1}$ can be sometimes formed in the electroconductive substrate.

Consequently a surface level of the substrate becomes uneven after being subjected in the washing step. For this reason, furthermore, a part of the intermediate layer to be applied thereon also becomes thicker while another part thereof becomes thinner. In the uneven intermediate layer, a local leak of electrons can be observed in its relatively thin portion, resulting in an defective image with a whiteness, an unexpected black dot, or the like. This kind of phenomena may be not observed at the beginning but it will be actualized with the accumulation of electrons after repeating image formations (for example forming images on 10,000 sheets of A-4 sized paper). In the case of the relatively thick portion of the intermediate layer, a residual potential is increased by the accumulated electrons and thus the image to be formed can be polluted or degraded.

SUMMARY OF THE INVENTION

An object of the present invention is to provide an organic electrophotographic photoconductor to be used for forming excellent images not only in early stages of repetitive printing but also in through stages thereof in spite of after subjecting the electroconductive substrate in the process including the step of treating with an organic base solvent such as trichloroethylene and Freon® as a cleaning agent.

In one aspect of the present invention, there is provided an electrophotographic photoconductor comprising:

an electroconductive substrate consisting of an aluminum alloy having an iron content of 0.1 percent by weight or less;

an intermediate layer formed on the electroconductive substrate;

a charge-generation layer formed on the intermediate layer; and a charge-transport layer formed on the charge generation layer.

Here, a surface of the electroconductive substrate may be cleaned by the process including a step of wet-washing by a water-soluble detergent.

The intermediate layer may mainly comprise an alcohol-soluble resin selected from a polyamide, a copolymer polyamide, polyvinyl alcohol, styrene/maleic acid resin, and melamine resin, preferably with a thickness of 0.5 μm or more, or more preferably with a thickness in the range of 0.5 μm to 3.0 μm.

The intermediate layer may mainly comprise an alcohol-soluble polyamide resin, and also comprises a styrene/ maleic acid resin, preferably with a thickness of 0.5 μm or more, or more preferably with a thickness in the range of 0.5 μm to 3.0 μm.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
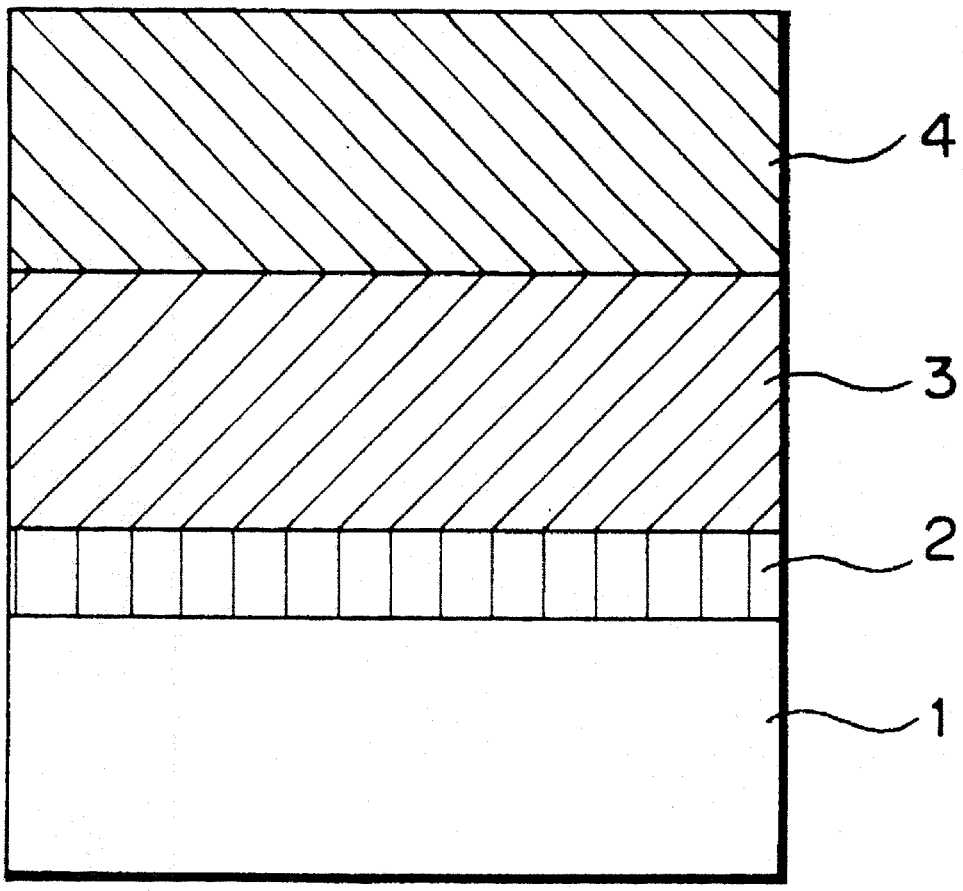
FIG. 1 is a schematic cross-sectional view of one of the preferred embodiments of the electrophotographic photoconductor in accordance with the present invention.

FIG. 1 is a schematic cross-sectional view of one of the preferred embodiments of the electrophotographic photoconductor in accordance with the present invention. The photoconductor is composed of an electroconductive substrate 1, an intermediate layer 2, a charge generation layer 3, and a charge transport layer 4. As shown in the figure, the layers 2, 3, and 4 are applied on the substrate 1 in that order.

In accordance with the invention, the electroconductive substrate 1 is made of an aluminum alloy. In this example, the aluminum alloy is in the type of containing 0.1% by weight or less of iron. However, it is possible to select from almost every types of the aluminum alloy, such as Japanese Industry Standard (JIS) 1,000 oder types, JIS 5,000 order types, and JIS 6,000 order types that satisfy the above iron content. A surface of the electroconductive substrate is shaved and ground to a predetermined surface roughness of $R_{max}$ (maximum height)=0.4 μm by means of grinding or the like, and also it is washed by a water-soluble detergent such as a water-soluble weak-alkali detergent, for example NF-10 (Lion Co., Ltd.), as a wet-type washing agent.

The intermediate layer 2 of the present invention is formed as a coating film mainly comprising alcohol-soluble resin, such as a copolymer nylon, N-alkoxyalkylate nylon, polyvinyl alcohol, styrene/maleic acid resin, and melamine resin with a thickness of 0.5 μm or more, or preferably with a thickness in the range of 0.5 μm to 3.0 μm.

The charge generation layer 3 is formed as a coating film of a mixture of an organic charge-generation substance and a resin binder. The charge-generation substance should be selected from appropriate substances in accordance with the wavelength of the exposure light to be used in the process of image formation, for example it can be selected from a group of phtalocyanine compounds. Non-metallic phthalocyanine can be preferably used in the case of using a semiconductor laser beam as a light source of the exposure. Furthermore, the resin binder can be preferably selected from a group of polycarbonate, polyester, polyamide, polyurethane, epoxy resin, methacrylate homo- and co-polyesters, silicone resin, vinyl chloride, vinyl chloride/vinyl acetate copolymer, polyvinyl butyral, polyvinyl acetate, polyvinyl alcohol, and mixture thereof.

The charge transport layer 4 is formed as a coating film comprising: at least one organic charge transfer substance such as polyvinyl carbazole, oxadiazole, imidazole, hydrazone, pyrazoline, and stilbene; and a resin binder. Also, the coating film may optionally comprise an anti-oxidizing agent, a UV absorber, or the like.

<Example 1>

An electrophotographic photoconductor as one of the preferred embodiments of the present invention was prepared as follows.

A conductive substrate (Sample 1) having a finished surface roughness (Rmax) of 0.5 μm was formed by grinding an outer surface of a cylindrical tube by a diamond tool. In this example, the cylindrical tube (30 mm in outside diameter and 250 mm in length) was made of an aluminum alloy consisting of the elements shown in Table 1.

TABLE 1

| A composition of the aluminum alloy of Sample 1 | Content (% by weight) |
|---|---|
| Si | 0.04 |
| Fe | 0.02 |
| Cu | — |
| Mn | — |
| Mg | 0.48 |
| Cr | — |
| Zr | — |
| Ti | — |
| Al | remains |

For cleaning a surface of the conductive substrate, it was suspended in a solution of 5% weak-alkali soluble detergent (trade name "NF-10" Lion Co., Ltd.) for 3 minutes at 50° C. and subjected to ultrasonic-cleaning. Then the cleaned substrate was subjected to brush-cleaning in a solution of 5% weak-alkali soluble detergent. After the cleaning, the conductive substrate was washed by a series of tap water (with ultrasonic for 3 min.); pure water (with ultrasonic for 3 min.); and extra pure water (with ultrasonic for 3 min.), and then dried by hot pure water at 70° C.

The conductive substrate was immersed in a coating solution to form an intermediate layer of 0.8 μm in thickness on its surface. The coating solution was prepared by dispersing 5 part by weight of alcohol-soluble nylon known by the trade name "CM8000" (Toray Industries Co., Ltd.) into 95 part by weight of methanol.

After the step of forming the intermediate layer, the conductive substrate was immersed in a coating solution to form a charge-generation layer of 0.1 μm in thickness on the surface of the intermediate layer. In this example, the coating solution was prepared by dispersing X-type non-metallic phthalocyanine (1 part by weight) and polyvinyl butyral (1 part by weight) in tetrahydrofuran (98 part by weight).

A charge transport layer of 20 μm in thickness was also formed on the charge generation layer of the conductive substrate by immersing the substrate in a coating solution comprising:

10 part by weight of a hydrazone compound (Anankoryo Co., Ltd. "CTC191");

10 part by weight of polycarbonate resin (Teijin Chemical Industries Co , Ltd., "L-1225"); and 80 part by weight of dichloroethane.

Consequently, an electrophotographic photoconductor (hereinafter referred to as photoconductor No. 1) was obtained.

The photoconductor No. 1 showed its excellent photosensitivities under the light beam (780 nm in wavelength) of semiconductor laser because the energy of its half-decay exposure is about 0.4 $\mu J/cm^2$.

For performing the printing test, the photoconductor No. 1 was installed in a commercially available laser beam printer known as the trade name "NEC PR-1000" (Nippon electric Co., Ltd.). In this example, the image quality of each copy was estimated by measuring light intensities at a printed area and an non-printed area of each copy as a printing concentration and a blank concentration respectively, by a Macbeth illuminometer. In an early periods of use, the printer provided excellent images with the printing concentration of 1.40, the blank concentration of 0.07; and four black dots (at least 0.1 mm in diameter) per an area of the copy printed by one rotation of the photoconductor No. 1 during the printing process.

After printing 50,000 sheets of A4-sized paper, the image qualities were also tested by means of Macbeth illuminometer. In this case, the printer also provided excellent images with the print concentration of 1.40; the blank concentration of 0.08; and five undesired black dots (at least 0.1 mm in diameter) per an area of the copy printed by one rotation of the photoconductor No. 1 during the printing process. Consequently, there was no difference between the image qualities of the above two stages.

<Examples 2–6>

Conductive substrates (samples 2–6) were prepared by the same way as that of Example 1 except that the compositions listed in the following table were used.

TABLE 2

| | sample No. | | | | |
|---|---|---|---|---|---|
| composition | 2 | 3 | 4 | 5 | 6 |
| Si | 0.03 | 0.08 | 0.18 | 0.07 | 0.06 |
| Fe | 0.02 | 0.03 | 0.05 | 0.09 | 0.12 |
| Cu | — | — | — | 0.02 | — |
| Mn | — | — | — | — | — |
| Mg | 0.48 | 0.60 | 0.53 | 0.50 | 0.55 |
| Cr | — | — | — | — | — |
| Zr | — | — | — | — | — |
| Ti | — | — | — | 0.02 | 0.01 |
| Al | R | R | R | R | R |

In the table, "R" means the remaining parts of the composition.

Furthermore, electrophotographic photoconductors Nos. 2–6 were prepared by using the conductive substrates (Samples 2–6), respectively, and tested by the same way as that of Example 1.

In the case of the electrophotographic photoconductors Nos. 2–5 having the conductive substrates of samples 2–5, respectively, the obtained images showed the excellent image qualities as well as Example 1 in both early and extended periods (i.e., before and after running tests). In the case of the electrophotographic photoconductor No. 6 using the conductive substrate of sample 6, on the other hand, the image qualities were decreased throughout the extended period. Though the electrophotographic photoconductor No. 6 provides the excellent image qualities as well as the other photoconductors in the early periods of use, it provides poor image qualities after the running test. That is, one hundred of the undesirable black dots were detected in the non-imaged area of the copy after the running test, which were 20 times greater than that of the early periods of use. As a result, the electrophotographic photoconductor No.6 had poor image qualities to be practical.

Consequently, it is preferable to contain 0.1% by weight or less of iron in the aluminum alloy of the electroconductive substrate.

<Examples 7–12>

Using the same way as that of the first example, conductive substrates were prepared and cleaned. In these examples 7–12, each substrate was made of the aluminum alloy having the same composition as that of Sample 5 described above, on which an intermediate layer, a charge-generation layer, and a charge-transport layer were applied in that order to form an electrophotographic photoconductor.

The photoconductors No. 7–12 were prepared so as to have different intermediate layer's thickness, respectively, and subjected to the running test of Example 1. The obtained results were listed in Table 3.

TABLE 3

| No. | thickness (μm) | sensitivity (μJ/cm$^2$) | black dots (number) | image quality |
|---|---|---|---|---|
| 7 | 0.1 | 0.3 | 100 | X |
| 8 | 0.3 | 0.3 | 30 | Δ |
| 9 | 0.5 | 0.4 | 5 | ○ |
| 10 | 0.8 | 0.4 | 5 | ○ |
| 11 | 1.2 | 0.5 | 4 | ○ |
| 12 | 2.0 | 0.5 | 5 | ○ |

In the table, "○" means that the resultant image had excellent image qualities; "Δ" means that the resultant image had poor image qualities as a matter of practicality; and "×" means that the resultant image could not be practicable.

As shown in Table 3, the number of undesired black dots increased with decreasing the thickness of the intermediate layer, for example the layer of 0.3 μm in thickness has a small number of the black dots compared with that of the layer of 0.1 μm in thickness. Consequently, it is desired that the thickness of the intermediate layer is 0.5 μm or more. The sensitivity of the photoconductor could not be decreased significantly when the thickness of the intermediate layer was up to 2 μm. In this case, there were no troubles found in the image so that both printing concentration and blank concentration were excellent.

From the results of Examples 1–12, therefore, an electrophotographic photoconductor of the present invention shows excellent photosensitivities and excellent properties of providing good image qualities without causing troubles. Because, the electrophotographic photoconductor of the present invention comprises a conductive substrate on which an intermediate layer, a charge-generation layer, and a charge transport layer are formed in that order. According to the present invention, the conductive substrate is made of aluminum alloy with the iron content of 0.1% by weight or less and the intermediate layer is made of an alcohol-soluble resin layer of 0.5 μm or more in thickness.

In accordance with the present invention, the organic electrophotographic photoconductor keeps its excellent photosensitivities and image-forming abilities to constantly provide images of high qualities in spite of in early or late stages of repeating the cycle of image formation. Furthermore, these excellent characteristics are not affected by the process of washing the electroconductive substrate before forming the intermediate layer thereon. That is, the conductive substrate can be subjected to the wet-washing process using a soluble detergent such as weak-alkali detergent without causing any troubles. Therefore, there is no need to use organic base solvent such as trichloroethylene and Freon® which are regarded as industrial pollutants that deplete the ozone layer. Thus the electrophotographic photoconductor of the present invention meets the demand of environmental protection.

The present invention has been described in detail with respect to preferred embodiments, and it will now be the changes and modifications may be made without departing form the invention in its broader aspects, and it is the intention, therefore, in the appended claims to cover all such changes and modifications as fall within the true spirit of the invention.

What is claimed is:

1. An electrophotographic photoconductor, comprising:

an electroconductive substrate consisting of an aluminum alloy having an iron content of 0.1 percent by weight or less;

an intermediate layer formed on said electroconductive substrate, which intermediate layer is comprised of a resin and has a thickness of at least 0.5 μm;

a charge-generation layer formed on said intermediate layer; and a charge-transport layer formed on said charge generation layer.

2. The electrophotographic photoconductor as claimed in claim 1, wherein a surface of said electroconductive substrate is a detergent cleaned surface and is cleaned by a process including wet-washing by a water-soluble detergent.

3. The electrophotographic photoconductor as claimed in claim 1, wherein said intermediate layer is comprised mainly of an alcohol-soluble resin selected from the group consisting of a polyamide, a polyamide copolymer, a polyvinyl alcohol, a styrene/maleic acid resin, and a melamine resin.

4. The electrophotographic photoconductor as claimed in claim 1, wherein said intermediate layer is comprised mainly of an alcohol-soluble polyamide resin, and is further comprised of a styrene/maleic acid resin.

5. The electrophotographic photoconductor as claimed in claim 1, wherein the intermediate layer has a thickness ranging between 0.5 to 3.0 μm.

6. The electrophotographic photoconductor as claimed in claim 2, wherein the intermediate layer has a thickness ranging between 0.5 to 3.0 μm.

7. The electrophotographic photoconductor as claimed in claim 3, wherein the intermediate layer has a thickness ranging between 0.5 to 3.0 μm.

8. The electrophotographic photoconductor as claimed in claim 4, wherein the intermediate layer has a thickness ranging between 0.5 to 3.0 μm.

* * * * *